US012000083B2

(12) United States Patent
Yu

(10) Patent No.: US 12,000,083 B2
(45) Date of Patent: Jun. 4, 2024

(54) GARMENT STEAMER

(71) Applicant: SHENZHEN PUKAIYU TECHNOLOGY CO., LTD., Jiangxi (CN)

(72) Inventor: Yonghua Yu, Guangdong (CN)

(73) Assignee: SHENZHEN PUKAIYU TECHNOLOGY CO., LTD., Jiujiang (CN)

( * ) Notice: Subject to any disclaimer, the term of this patent is extended or adjusted under 35 U.S.C. 154(b) by 0 days.

(21) Appl. No.: 18/119,298

(22) Filed: Mar. 9, 2023

(65) Prior Publication Data

US 2023/0243087 A1 Aug. 3, 2023

Related U.S. Application Data

(63) Continuation-in-part of application No. 17/476,497, filed on Sep. 16, 2021, now abandoned.

(51) Int. Cl.

| | |
|---|---|
| ***D06F 87/00*** | (2006.01) |
| ***D06F 75/10*** | (2006.01) |
| ***D06F 75/14*** | (2006.01) |
| ***D06F 75/18*** | (2006.01) |
| ***D06F 75/20*** | (2006.01) |
| ***D06F 75/24*** | (2006.01) |

(Continued)

(52) U.S. Cl.

CPC ..... *D06F 87/00* (2013.01); *D06F 75/14* (2013.01); *D06F 75/20* (2013.01); *D06F 75/24* (2013.01); *D06F 75/30* (2013.01); *F22B 1/284* (2013.01)

(58) Field of Classification Search

None

See application file for complete search history.

(56) References Cited

U.S. PATENT DOCUMENTS 2,480,337 A * 8/1949 Pearce ..... A47J 27/004 219/415
3,130,328 A * 4/1964 Moore ..... H02P 4/00 307/130

(Continued)

FOREIGN PATENT DOCUMENTS

CN 110793010 A * 2/2020
CN 111315044 A * 6/2020

(Continued)

OTHER PUBLICATIONS

CN110793010, Feb. 2020, Huang, partial translation. (Year: 2020).*

(Continued)

*Primary Examiner* — Joseph M. Pelham

(57) ABSTRACT

The present disclosure provides a garment steamer which includes a water tank configured to store water, an evaporator assembly communicated with the water tank and configured to generate steam, and a switching member. The evaporator assembly includes a first heating member and a second heating member, a resistance of the first heating member meets 110V power supply, a resistance of the second heating member meets 220V power supply. The switching member is configured to connect 110V power supply to the first heating member or connect 220V power supply to the second heating member automatically.

15 Claims, 14 Drawing Sheets

(51) Int. Cl.
*D06F 75/30* (2006.01)
*F22B 1/28* (2006.01)

(56) References Cited

U.S. PATENT DOCUMENTS

| | | | | | |
|---|---|---|---|---|---|
| 3,586,940 | A * | 6/1971 | Benirschke | B26B 19/284 | 307/130 |
| 4,267,430 | A * | 5/1981 | Downey | A45D 1/04 | 362/136 |
| 4,731,519 | A * | 3/1988 | Dieterle | A45D 1/04 | 219/250 |
| 5,001,623 | A * | 3/1991 | Magid | H02M 1/10 | 307/130 |
| 2010/0166396 | A1* | 7/2010 | Xu | D06F 73/00 | 392/394 |
| 2015/0128664 | A1* | 5/2015 | Date | D06F 75/20 | 223/51 |
| 2019/0316289 | A1* | 10/2019 | Cordier | D06F 87/00 | |
| 2019/0376229 | A1* | 12/2019 | D'Oliviera Dias | D06F 75/40 | |
| 2020/0123699 | A1* | 4/2020 | Gelus | D06F 75/20 | |
| 2021/0152078 | A1* | 5/2021 | Lee | H02M 5/257 | |

FOREIGN PATENT DOCUMENTS

| | | | | |
|---|---|---|---|---|
| CN | 111945403 | A * | 11/2020 | |
| CN | 212560856 | U * | 2/2021 | |
| CN | 110621821 | B * | 10/2021 | D06F 75/14 |
| EP | 3771769 | A1 * | 2/2021 | D06F 87/00 |

OTHER PUBLICATIONS

CN111315044, Jun. 2020, Luo, partial translation. (Year: 2020).*
CN110793010, Feb. 2020, Huang, Bib data sheet. (Year: 2020).*
CN111315044, Jun. 2020, Luo, Bib data sheet. (Year: 2020).*

* cited by examiner

GARMENT STEAMER

CROSS-REFERENCE TO RELATED APPLICATIONS

This application is a continuation-in-part of U.S. application Ser. No. 17/476,497, filed Sep. 16, 2021. The disclosure of which is hereby incorporated by reference in its entirety.

FIELD

The present disclosure relates to household appliances, and in particular to a garment steamer.

BACKGROUND

A garment steamer is a household appliance in which an evaporator is arranged to generate steam. The evaporator is designed to operate at 110V commercial voltage or 220V commercial voltage. When the 110V garment steamer is connected to the 220V commercial power source, there is a possibility that a fire is generated and, as such, the user is exposed to great danger. On the other hand, when the 220V garment steamer is connected to the 110V commercial power source, the garment steamer cannot perform a desired intrinsic function thereof.

SUMMARY

In a first aspect, the present disclosure provides a garment steamer which includes a water tank configured to store water, an evaporator assembly communicated with the water tank and configured to generate steam, and a switching member. The evaporator assembly includes a first heating member and a second heating member, a resistance of the first heating member meets 110V power supply, a resistance of the second heating member meets 220V power supply. The switching member is configured to connect 110V power supply to the first heating member or connect 220V power supply to the second heating member automatically.

In a second aspect, the present disclosure provides a garment steamer which includes a water tank configured to store water, an evaporator assembly communicated with the water tank and configured to generate steam, a water pump configured to pump water from the water tank to the evaporator assembly, and a step-down module. The water pump has a power of about 1-10 w. The step-down module is configured to lower an input voltage of 220V power supply to an operating voltage suitable for the first water pump.

In a third aspect, the present disclosure provides a garment steamer which includes a water tank configured to store water, an evaporator assembly communicated with the water tank and configured to generate steam, a first water pump, a second water pump, and a switching member. The evaporator assembly includes a first heating member and a second heating member, a resistance of the first heating member meets 110V power supply, a resistance of the second heating member meets 220V power supply. A power of the second water pump is greater than that of the first water pump. The switching member is configured to connect 110V power supply to the first heating member and first water pump or connect 220V power supply to the second heating member and second water pump automatically.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

Figure 1:
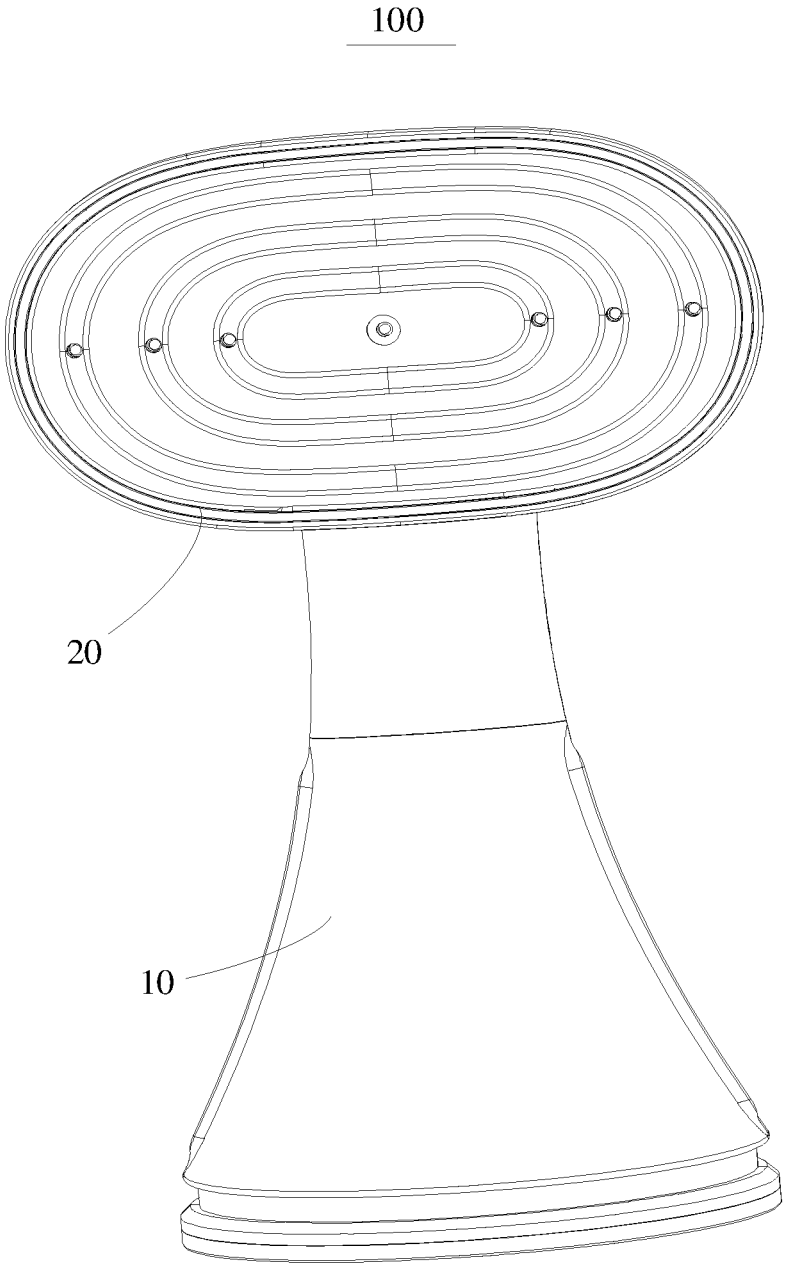
FIG. 1 is a structure diagram of a garment steamer according to an embodiment of the present disclosure.
Figure 2:
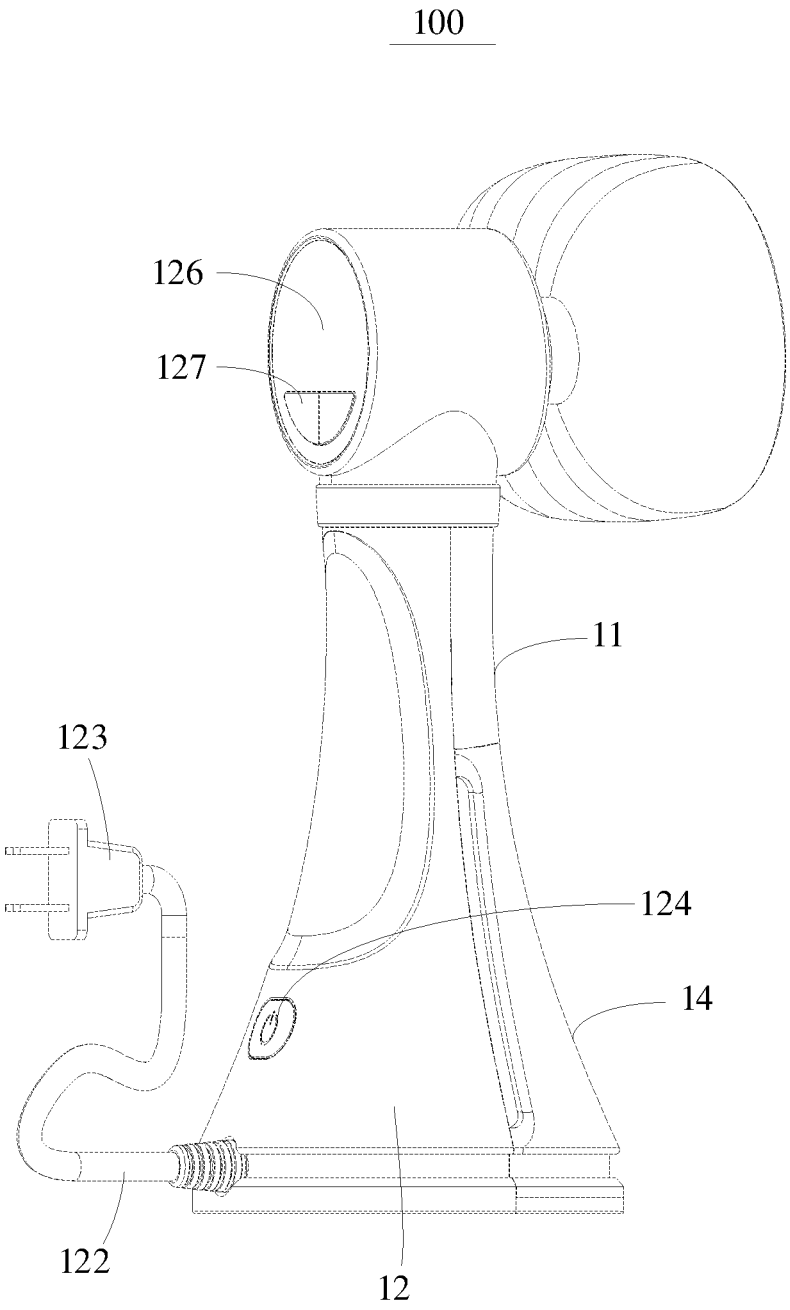
FIG. 2 is another structure diagram of the garment steamer of FIG. 1.
Figure 3:
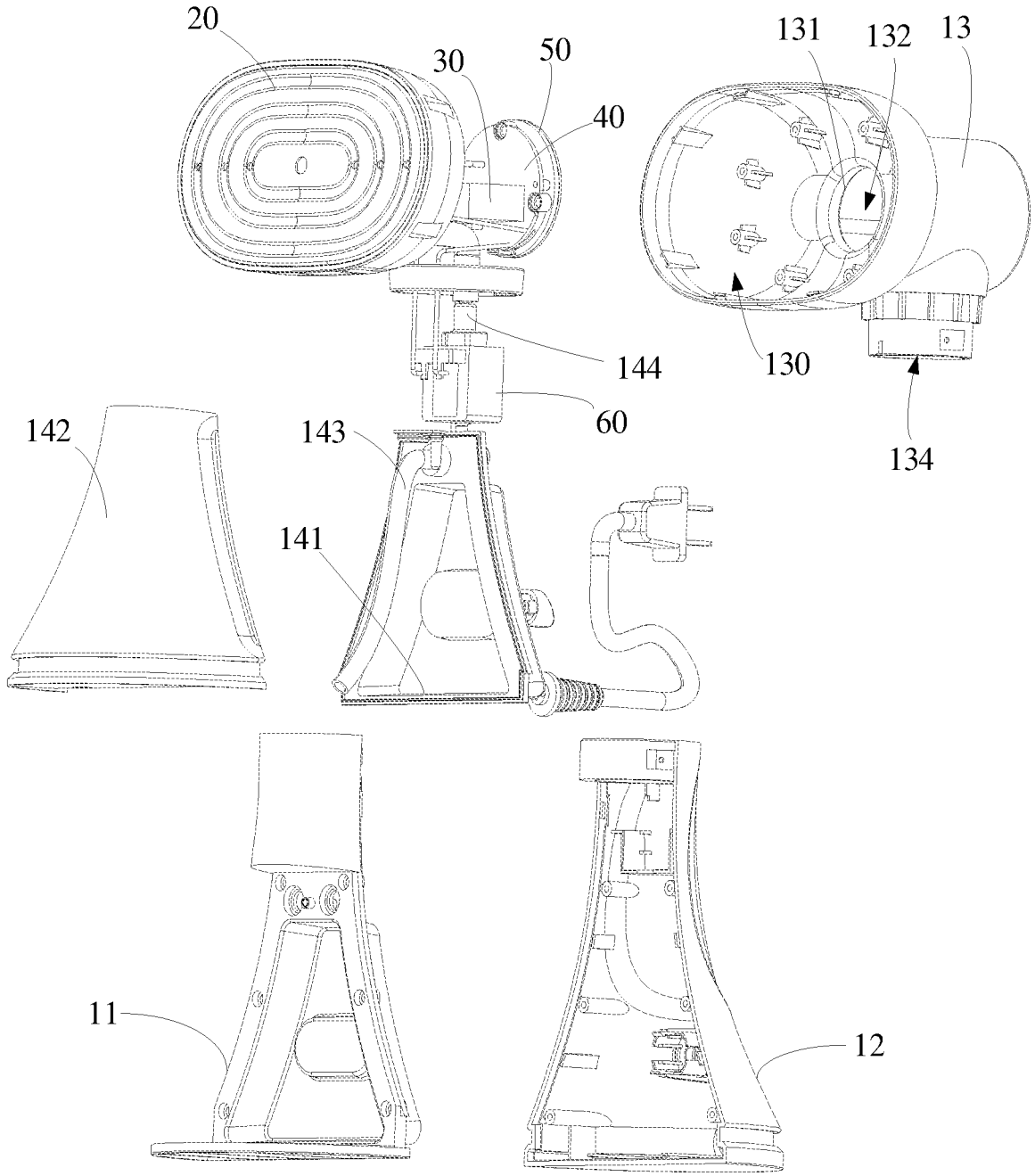
FIG. 3 is an exploded diagram of the garment steamer of FIG. 1.
Figure 4:
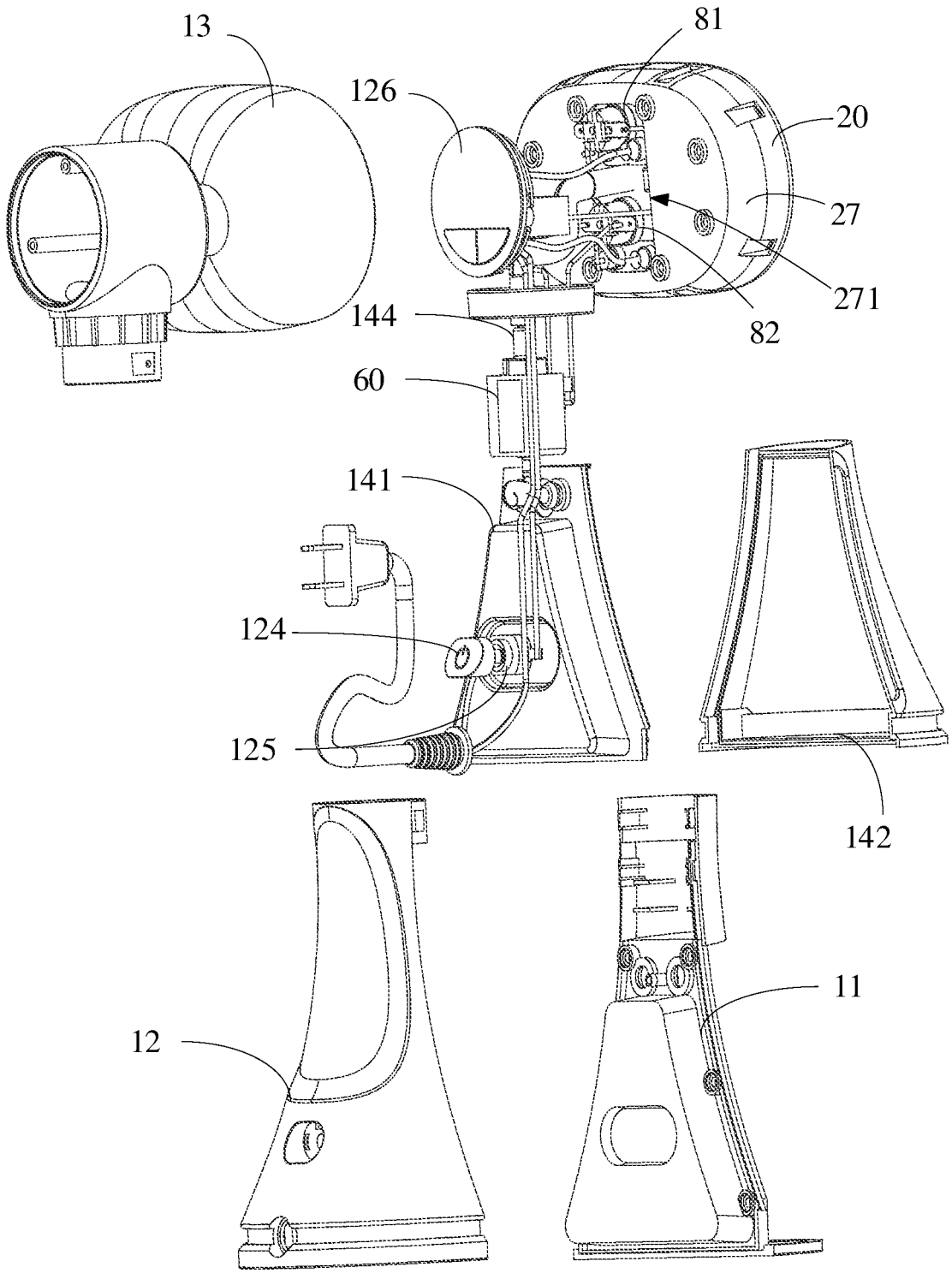
FIG. 4 is another exploded diagram of the garment steamer of FIG. 1.
Figure 5:
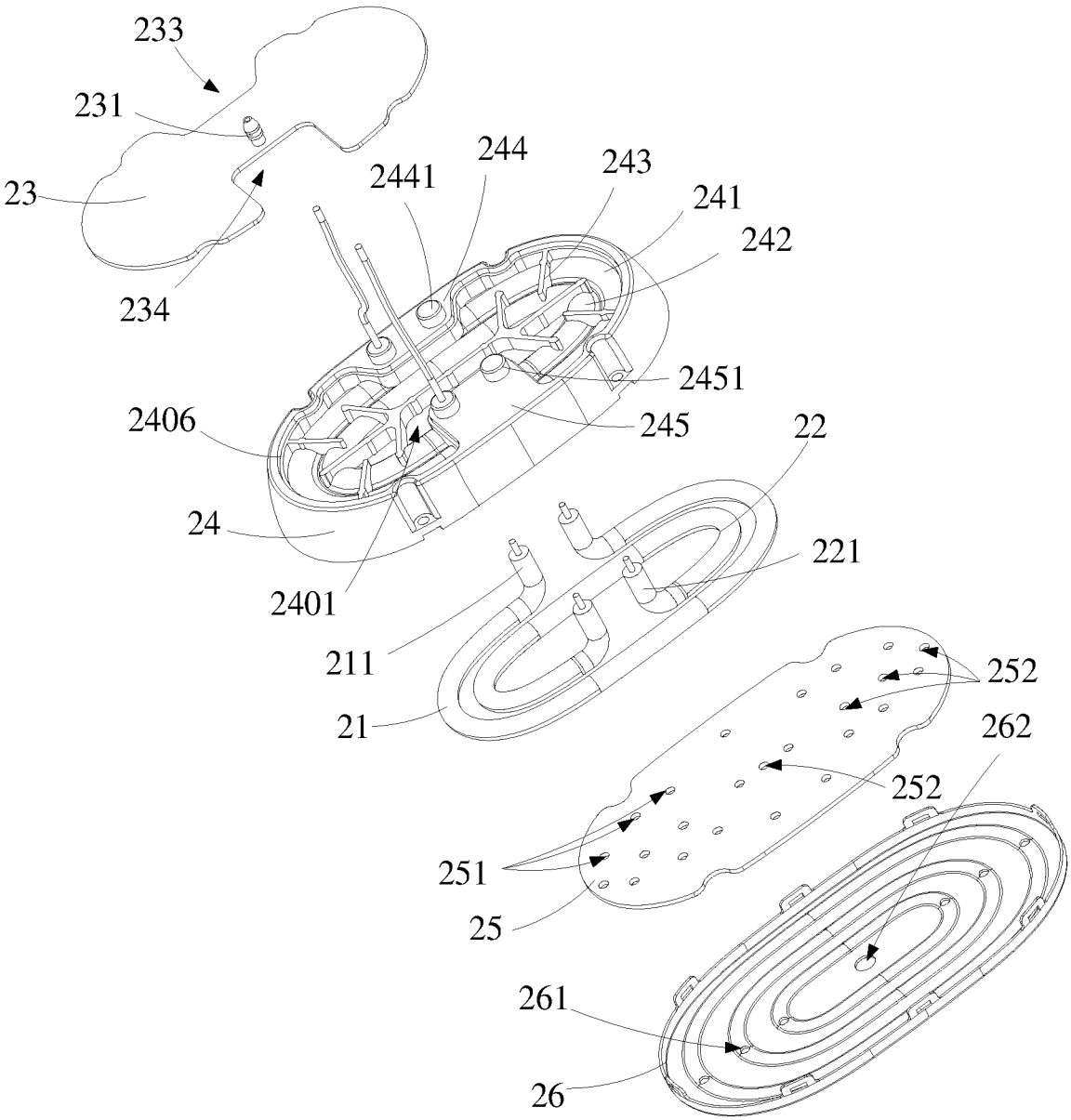
FIG. 5 is an exploded diagram of a part of an evaporator assembly of FIG. 3.
Figure 6:
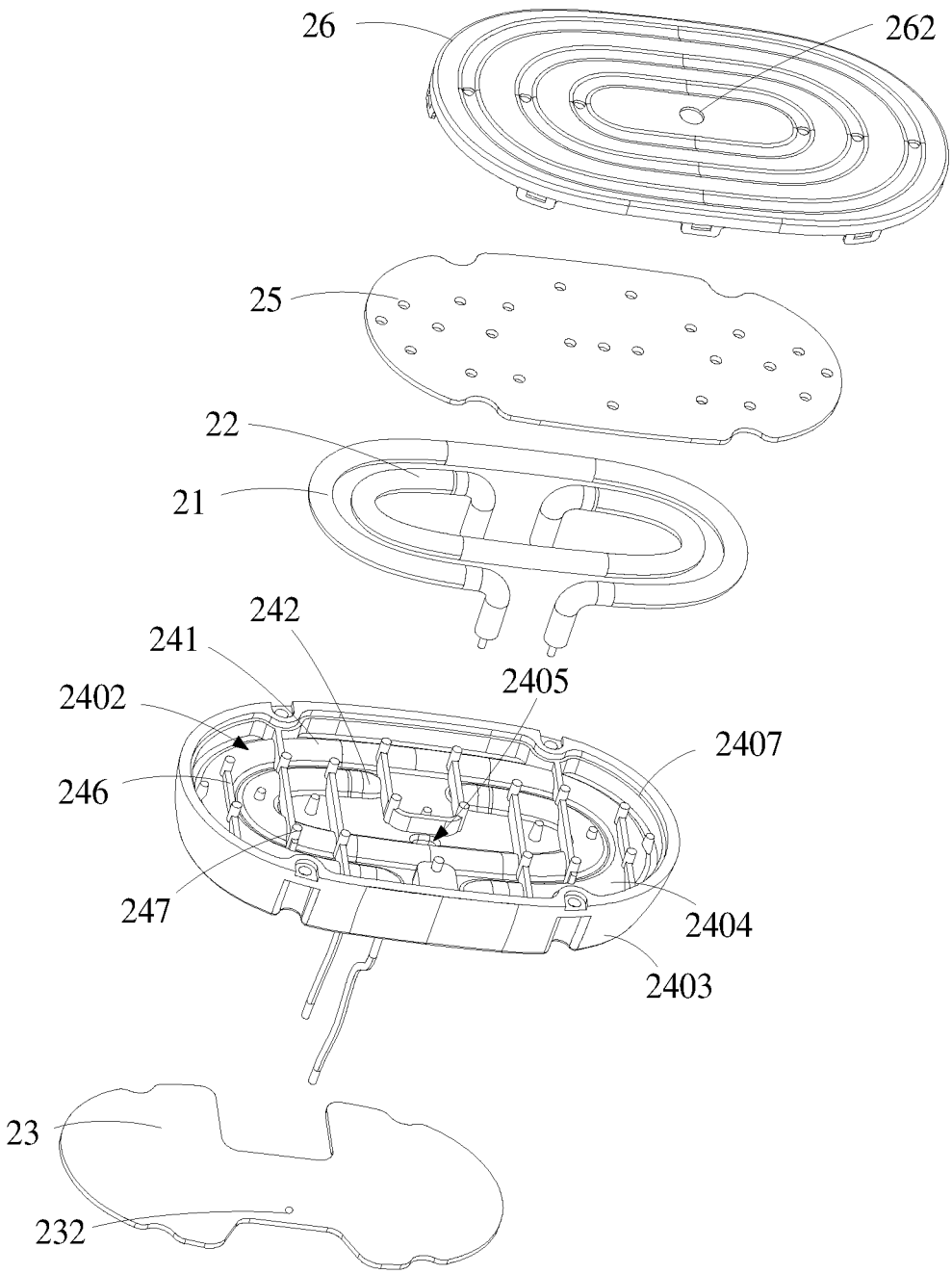
FIG. 6 is another exploded diagram of a part of the evaporator assembly of FIG. 3.
Figure 7:
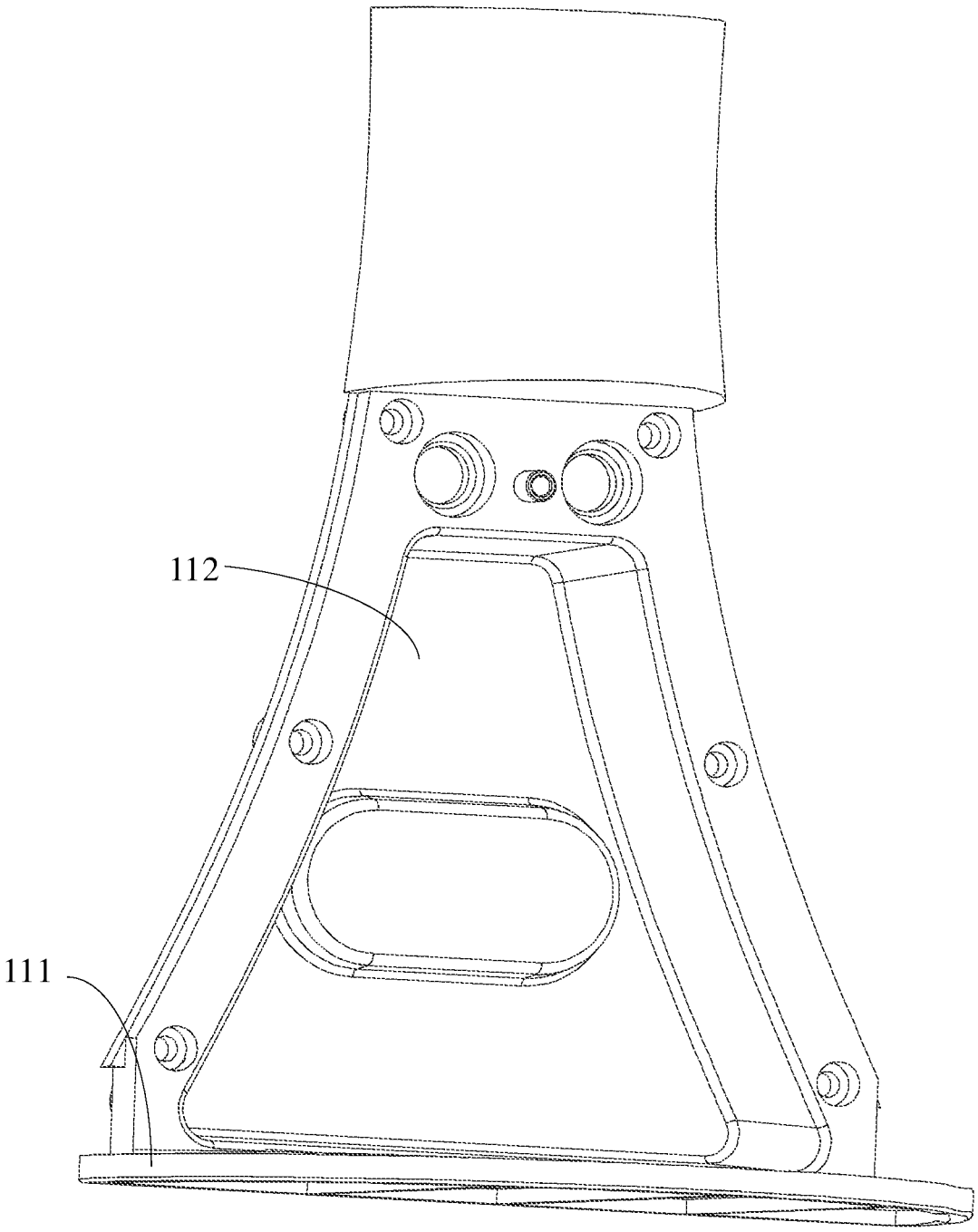
FIG. 7 is a structure diagram of a first sub housing of FIG. 3.
Figure 8:
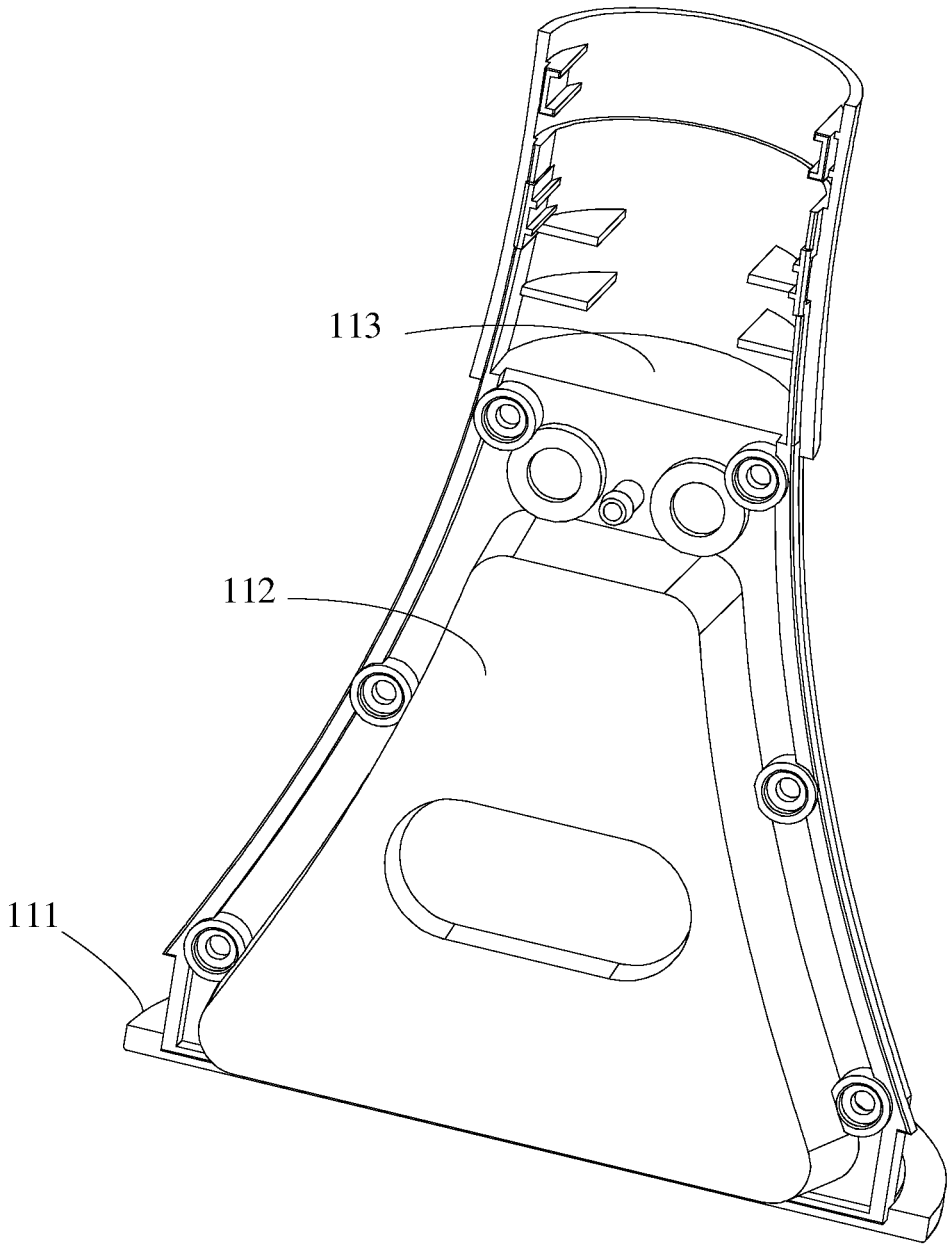
FIG. 8 is another structure diagram of the first sub housing of FIG. 3.
Figure 9:
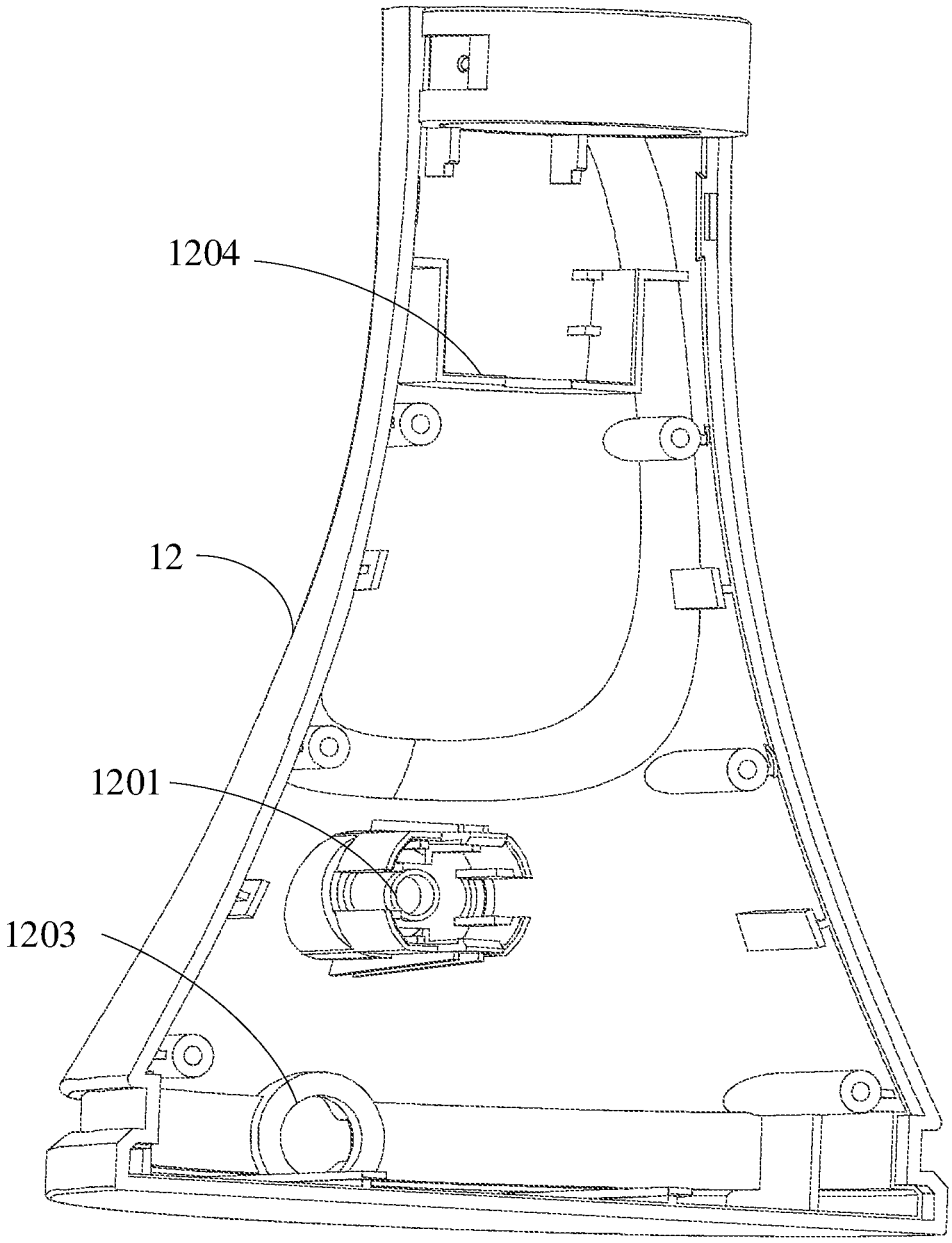
FIG. 9 is a structure diagram of a second sub housing of FIG. 3.
Figure 10:
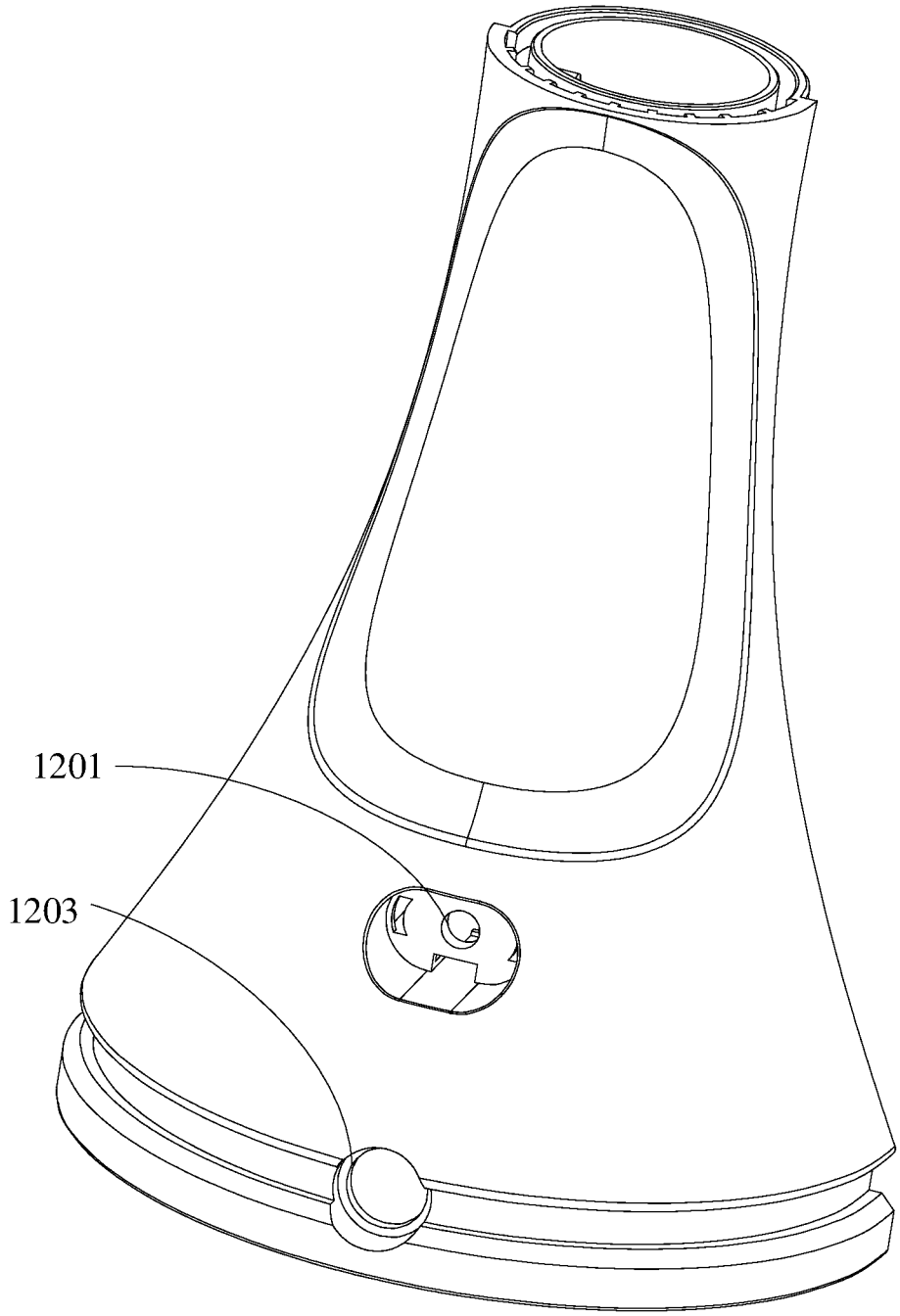
FIG. 10 is another structure diagram of the second sub housing of FIG. 3.
Figure 11:
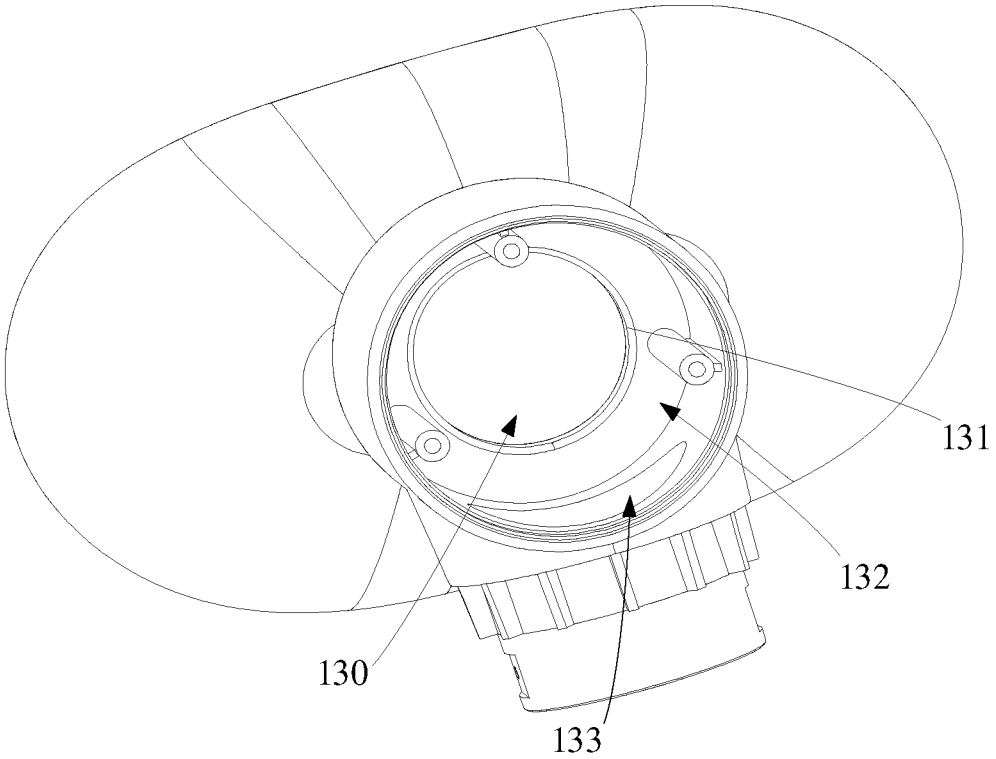
FIG. 11 is a structure diagram of a third sub housing of FIG. 3.
Figure 12:
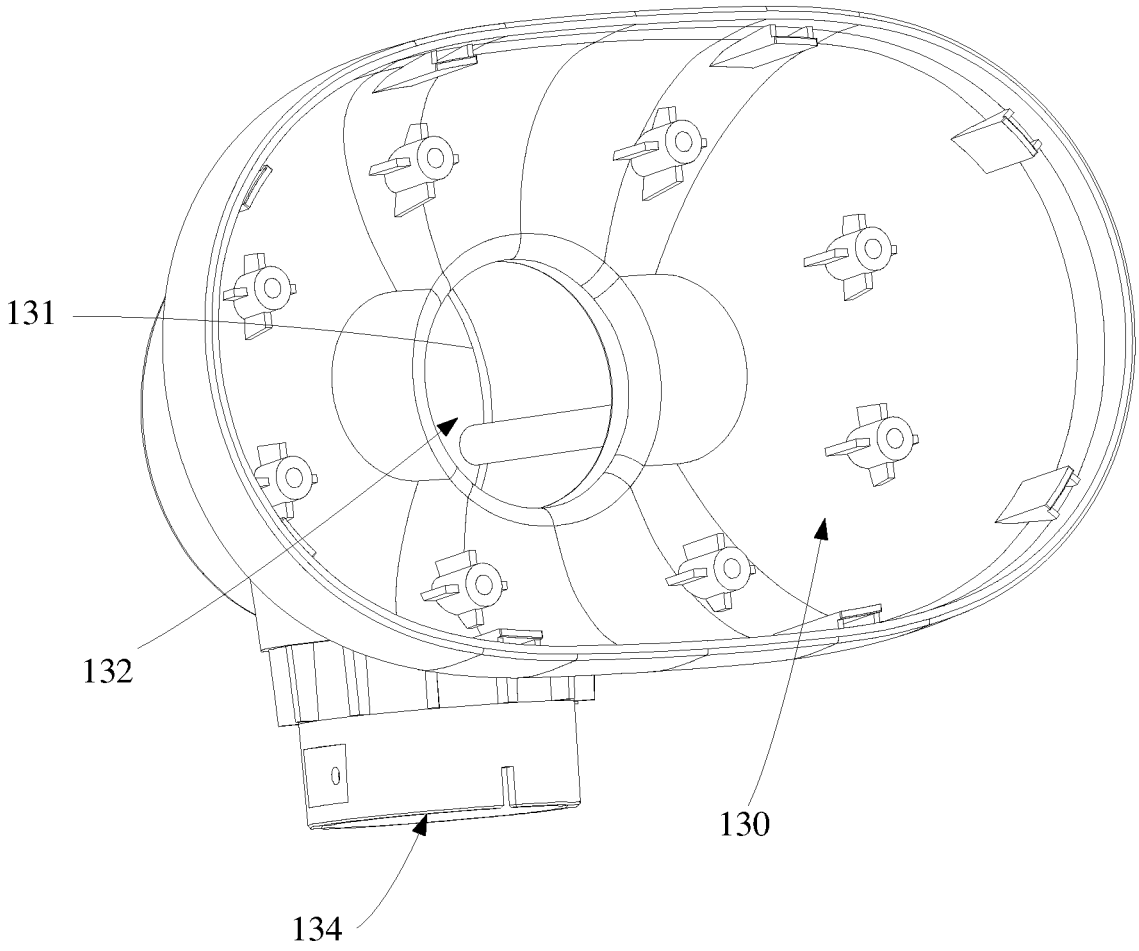
FIG. 12 is another structure diagram of the third sub housing of FIG. 3.
Figure 13:
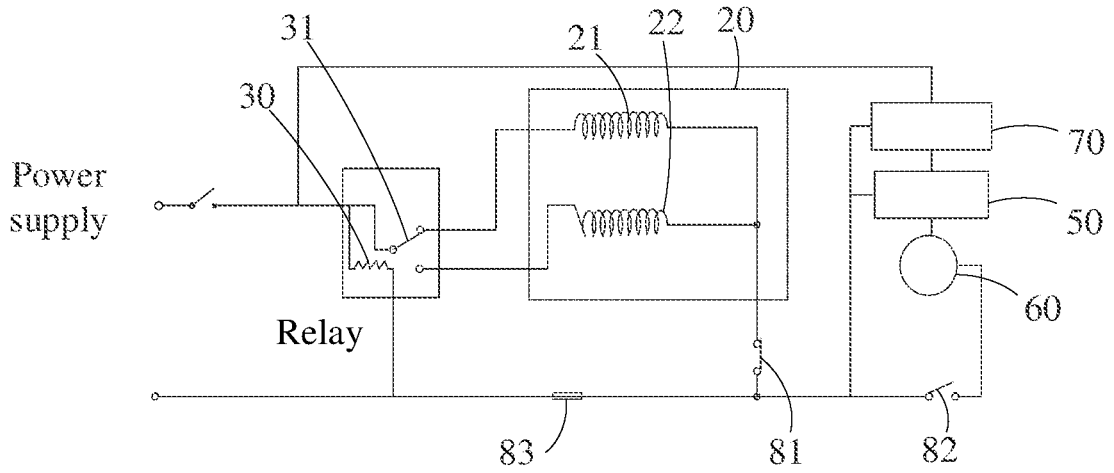
FIG. 13 is a circuit diagram explaining an operation of the garment steamer of FIG. 1.

The realization of the aim, functional characteristics, advantages of the present disclosure are further described specifically with reference to the accompanying drawings and embodiments.

DETAILED DESCRIPTION

The technical solutions of the embodiments of the present disclosure will be clearly and completely described in the following with reference to the accompanying drawings. It is obvious that the embodiments to be described are only a part rather than all of the embodiments of the present disclosure. All other embodiments obtained by persons skilled in the art based on the embodiments of the present disclosure without creative efforts shall fall within the protection scope of the present disclosure.

Referring to FIGS. 1-13, the present disclosure provides a garment steamer 100 according to an embodiment, the garment steamer 100 may a handheld garment steamer.

The garment steamer 100 includes a housing 10, a water tank 14 configured to store water, an evaporator assembly 20 communicated with the water tank 14 and configured to generate steam, a relay 30 configured to connect the evaporator assembly 20 to a power supply. The power supply supplies AC voltage of 110-220V. The evaporator assembly 20 includes a first heating member 21 and a second heating member 22, a resistance of the first heating member 21 meets 110V power supply, a resistance of the second heating member 22 meets 220V power supply, and the relay 30 connects 110V power supply to the first heating member 21 or connects 220V power supply to the second heating member 22 automatically. In this way, the garment steamer 100 is capable of safely operating while generating a constant output without requiring a separate user operation even when the garment steamer 100 is connected to the power supply either 100V or 220V.

The relay 30 includes a first switch 31 normally connected with the first heating member 21. When the garment steamer 100 is connected with 110V power supply, the first switch 31 remains connecting with the first heating member 21; and when the garment steamer 100 is connected with 220V power supply, the relay 30 generates a first magnetic force capable of moving the first switch 31 to connect with the second heating member 22. In one embodiment, the relay 30 is an AC 220V relay, and the first switch 31 of the relay 30 is normally connected with the first heating member 21, when the garment steamer 100 is connected to the power supply with a voltage less than 176V, the magnetic force generated by the relay 30 is too small to move and connect with the second heating member 22, and the first switch 31 remains connecting with the first heating member 21; when the garment steamer 100 is connected to the power supply with a voltage no less than 176V, the magnetic force generated by the relay 30 is capable of moving the first switch 31 to connect with the second heating member 22 within about 20 ms. The first switch 31 moves in such a short time to disconnect with the first heating member 21, so the first heating member 21 may not been damaged.

The first heating member 21 and the second heating member 22 are both made of metal, such as aluminium, aluminium alloy, copper, copper alloy, magnesium oxide, or the like. The first heating member 21 and the second heating member 22 are two independent components, and the first heating member 21 and the second heating member 22 may be cast in the evaporation chamber 24. The first heating member 21 is a tubular heating coil, and the second heating member 22 is a tubular heating coil. The first heating member 21 surrounds the second heating member 22.

The evaporator assembly 20 further includes an evaporation chamber 24 communicated with the water tank 14, a first cover 23 configured to cover a first side of the evaporation chamber 24, a first receiving member 241 arranged in the evaporation chamber 24 and configured to receive the first heating member 21, a second receiving member 242 arranged in the evaporation chamber 24 and configured to receive the second heating member 22, a second cover 25 configured to cover a second side of the evaporation chamber 24, and a back cover 27 connected with the evaporation chamber 24. The first heating member 21 and the second heating member 22 may be cast in the evaporation chamber 24, and sealed in the first receiving member 241 and the second receiving member 242 respectively.

The first heating member 21 and the second heating member 22 are received in the evaporation chamber 24 to heat water in the evaporation chamber 24. The evaporation chamber 24, the first receiving member 241, the second receiving member 242, the first cover 23 and the back cover 27 cooperatively define a first sub evaporation chamber 2401. The evaporation chamber 24, the first receiving member 241, the second receiving member 242, the second cover 25 and the back cover 27 cooperatively define a second sub evaporation chamber 2402 communicated with the first sub evaporation chamber 2401.

The first cover 23 includes an inlet portion 231 communicated with the water tank 14, and a first through hole 232 configured to communicate the inlet portion 231 with the first sub evaporation chamber 2401. The second cover 25 defines a plurality of second through holes 251, and a plurality of third through holes 252 communicated with the second sub evaporation chamber 2402, the steam generated in the evaporation chamber 24 flows out through the third through holes 252. The plurality of third through holes 252 are arranged in a line, and the second through holes 251 surround the third through holes 252.

The evaporation chamber 24 includes a side wall 2403 and a middle wall 2404, the middle wall 2404 defines at least one third through hole 2405 for communicating the first sub evaporation chamber 2401 with the second sub evaporation chamber 2402. The third through hole 2405 may be defined in a middle portion of the middle wall 2404. The side wall 2403, the middle wall 2404, the first receiving member 241, the second receiving member 242, and the first cover 23 cooperatively define the first sub evaporation chamber 2401. The side wall 2403, the middle wall 2404, the first receiving member 241, the second receiving member 242, and the second cover 25 cooperatively define the second sub evaporation chamber 2402. In one embodiment, the first receiving member 241 and the second receiving member 242 are protruded from two sides of the middle wall 2404.

The first sub evaporation chamber 2401 is provided with a plurality of first water guiding portions 243, the first water guiding portions 243 cooperatively form at least one first water flowing channel. The second sub evaporation chamber 2402 is also provided with a plurality of second water guiding portions 246, the second water guiding portions 246 cooperatively form at least one second water flowing channel. In one embodiment, each of the first water flowing channel and the second water flowing channel is symmetrical arranged.

The side wall 2403 is protruded with a first connecting plate 244 and a second connecting plate 245, the first connecting plate 244 and the second connecting plate 245 extend towards each other. The first connecting plate 244 is provided with two first connecting portions 2441, the second connecting plate 245 is provided with two second connecting portions 2451, the first heating member 21 includes two connecting ends 211, and the second heating member 22 includes two connecting ends 221 electronically connected with the relay 30, the connecting ends 211 are received in the first connecting portions 2441 and electronically connected with the relay 30, the connecting ends 221 are received in the second connecting portions 2451 and electronically connected with the relay 30.

In one embodiment, a length of the first heating member 21 is larger than that of the second heating member 22. For this reason, the first heating member 21 with low resistance can also have a high heating efficiency. It should be understood that, the length of the second heating member 22 can also be set to be larger than that of the first heating member 21.

The first heating member 21 is substantially ring shaped, elliptical shaped, square shaped, hexagonal shaped, triangular shaped or irregular shaped. The two connecting ends 211 of the first heating member 21 are separated from each other and extended towards the first connecting portions 2441. The second heating member 22 is substantially ring shaped, elliptical shaped, square shaped, hexagonal shaped, triangular shaped or irregular shaped. The two connecting ends 221 of the second heating member 22 are also separated from each other and extended towards the second connecting portions 2451. The first heating member 21 surrounds the second heating member 22, and the two connecting ends 221 are arranged at a side of the first heating member 21 away from the connecting ends 211, for preventing a short-circuit caused by a faulty connection between the wires and increasing a space for connecting the wires with the ends.

The side wall 2403 includes a first step 2406 and a second step 2407 which are both arranged along an inner surface of the side wall 2403. The first cover 23 is arranged on the first step 2406 and the second cover 25 is arrange on the second step 2407. The first cover 23 defines two notches 233 and 234, the first connecting plate 244 and the second connecting plate 245 are received in the notches 233 and 234, respectively.

The evaporation assembly 20 further includes a plurality of positioning rods 247 which are arranged on the second water guiding portions 246, the middle wall 2404, the first receiving members 241 and the second receiving members 242. In one embodiment, the positioning rods 247 are received in the second through holes 251 of the second cover 25, and at least one of the positioning rods 247 does not completely occupy the corresponding second through hole 251, that is, a gap is defined between an outer wall of the at least one of the positioning rods 247 and an inner wall of the corresponding second through hole 251, so the steam generated in the first and second sub evaporation chambers can flow through the second through hole 251. In another embodiment, the positioning rods 247 are received in the second through holes 251 of the second cover 25, and the positioning rods 247 completely occupy the second through holes 251. In a further embodiment, some positioning rods 247 are received in the second through holes 251, and some positioning rods 247 are received in the third through holes 252, the second through holes 251 may be completely filled by the positioning rods 247 or partially filled by the positioning rods 247, the third through holes 252 are partially filled by the positioning rods 247, and the steam generated in the first and second sub evaporation chambers can flow through the third through holes 252.

The plurality of third through holes 252 are arranged in a line, and the second through holes 251 surround the third through holes 252 or arranged on two sides of the third through holes 252 respectively. The evaporation assembly 20 further includes an outer cover 26 which defines a plurality of first outlets 261 and a second outlet 262. In one embodiment, the first outlet 261 has a diameter of about 10-20 mm, and the second outlet 262 has a diameter of about 40-80 mm. Several third through holes 252 in a middle portion of the second cover 25 correspond to the the second outlet 262, and the remaining third through holes 252 correspond to their respective the first outlets 261. In one embodiment, the third through hole 252 has the same diameter as the second through hole 251, the positioning rods 247 include a plurality of first positioning rods and a plurality of second positioning rod, the first positioning rods are received in their respective second through holes 251 to connect the cover 25 with the outer cover 26, a size of the first positioning rod is equal to that of the second through hole 251, or slightly smaller than that of the second through hole 251, the second through holes 251 may be completely filled by their respective first positioning rods, or a first small gap is formed between the first positioning rod and an inner wall of the second through hole 251 and the steam generated in the first and second sub evaporation chambers can flow through the first small gaps. A size of the second positioning rod is smaller than that of the third through hole 252, the second positioning rod are partially received in their respective third through holes 252, a second gap is formed between the first positioning rod and an inner wall of the second through hole 251, and the steam generated in the first and second sub evaporation chambers can flow through the second gaps.

The garment steamer 100 further includes a single chip unit 50 (also named micro-controller) and a water pump 60 electronically connected with the single chip unit 50. The water pump 60 can pump water in the water tank 14 into the evaporation chamber 24. The water pump 60 is equipped with a motor, the single chip unit 50 can control a water pump speed of the water pump 60 to adjust a steam output amount. The water pump 60 has a relative lower power, about 1-10 w, and the low power water pump 60 is small in size and suitable for the garment steamer 100. The garment steamer 100 further includes a step-down module 70 electronically connected with the single chip unit 50, the step-down module 70 is configured to lower an input voltage (220V) to an operating voltage suitable for the low power water pump 60. The step-down module 70 may be an AC-DC step-down transformer. In one embodiment, the step-down module 70 may be integrated in the PCB board 40. In another embodiment, the step-down module 70 and the PCB board 40 are two independent components, the step-down module 70 is arranged on and electrically connected with the PCB board.

The high power water pump is usually large in size and may occupy a larger inner space of the garment steamer 100, and the high power water pump may be operated well at 220V power supply. The low power water pump 60 is small in size and can be operated well at 110V power supply. When the garment steamer 100 is provided with 220V power supply, the step-down module 70 lowers the input voltage (220V) to the operating voltage suitable for the water pump 60. In this way, the water pump 60 can work well when the garment steamer 100 is connected to the power supply either 100V or 220V without increasing the size of the garment steamer 100.

The garment steamer 100 further includes a first connecting pipe 143 configured to communicate the water tank 14 with the water pump 60, and a second connecting pipe 144 configured to communicate the water pump 60 with the evaporation assembly 20. The water tank 14 includes a first portion 141 and a second portion 142, the first portion 141 encloses with the second portion 142 to defines a space for storing the water. The first connecting pipe 143 extends into the space. The water pump 60 is arranged above the water tank 14, and the first connecting pipe 143 and the second connecting pipe 144 are connected with two sides of the water pump 60 respectively.

The garment steamer 100 further includes a first temperature controller 81 and a second temperature controller 82. The first temperature controller 81 is configured to detect a first temperature of the evaporator assembly 20 and disconnect the evaporator assembly 20 from the power supply when the first temperature exceeds a first preset temperature. The second temperature controller 82 is configured to detect a second temperature of the evaporator assembly 20 and control the water pump 60 to pump the water in the water tank 14 into the evaporator assembly 20 when the second temperature reaches a second preset temperature. The back cover 27 defines a mounting portion 271 for mounting the first temperature controller 81 and the second temperature controller 82, the second connecting pipe 144 passes through the mounting portion 271 to communicate with evaporation chamber 24. In one embodiment, the first temperature controller 81 has a normally-closed switch, and the second temperature controller 82 has a normally-open switch.

The garment steamer 100 further includes a housing 10, a switch 124 arranged on the housing 10, a display panel 126 arranged on the housing 10, at least one button 127 arranged on the display panel 126, a PCB board 40, a fuse 83 and a plug 123 electronically connected with the PCB board 40. The water tank 14 is partially exposed from the housing 10.

The housing 10 includes a first sub housing 11, a second sub housing 12 connected with the first sub housing 11, and a third sub housing 13 for receiving the relay 30, the PCB board 40, the single chip unit 50 and a part of the evaporation assembly 20.

The first sub housing 11 includes a support portion 111 for supporting the water tank 14, a receiving portion 112 for partially receiving the water tank 14, and a first mounting portion 113. The second sub housing 12 defines a fourth through hole 1202 from which the switch 124 exposes, and a fifth through hole 1203 through which a cable 122 passes, and the plug 123 is connected with the cable 122. The garment steamer 100 is connected with the power supply by the cable 122 and the plug 123. The second sub housing 12 further includes a second mounting portion 1204, the water pump 60 is mounted on the first mounting portion 113 and the second mounting portion 1204.

The third sub housing 13 defines a first receiving cavity 130, a sixth through hole 131, a second receiving space 132 communicated with the first receiving cavity 130 by the sixth through hole 131, a seventh through hole 133, and a channel 134 communicated with the second receiving space 132 by the seventh through hole 133. The first receiving cavity 130 is configured to receive a part of the evaporation assembly 20. The second receiving space 132 is configured to receive the relay 30, the PCB board 40 and the single chip unit 50. The second connecting pipe 144 passes through the channel 134, the second receiving space 132, and the first receiving cavity 130 to communicate with the evaporation chamber 24.

Figure 14:
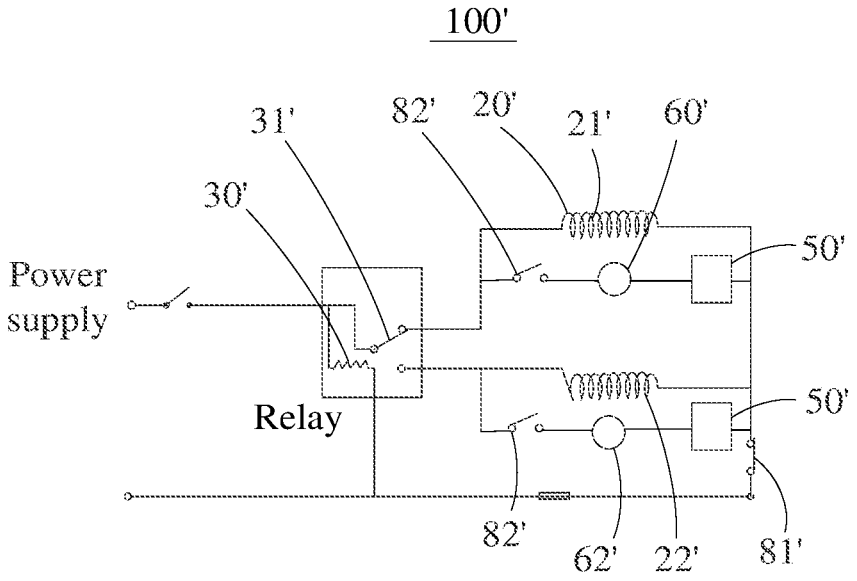
FIG. 14 is a circuit diagram explaining an operation of a garment steamer according to a second embodiment.

Referring to FIG. 14, the present disclosure further provides a garment steamer 100' according to a second embodiment. The garment steamer 100' is similar with the garment steamer 100, the differences between the two at least include: the garment steamer 100' further includes a high power water pump 62' which may be operated well at 220V power supply; a power of the high power water pump 62 is about 11-24 w; the high power water pump 62' and the low power water pump 60' are both electrically connected with the relay 30' and communicated with the evaporation assembly 20'. The single chip unit 50' can also control a water pump speed of the high power water pump 62' to adjust a steam output amount.

The first switch 31' of the relay 30' is normally connected with the first heating member 21' and the low power water pump 60'. When the garment steamer 100' is connected to the power supply with a voltage less than 176V, the magnetic force generated by the relay 30' is too small to move and connect with the second heating member 22' and the high power water pump 62', and the first switch 31' remains connecting with the first heating member 21' and the low power water pump 60'; when the garment steamer 100' is connected to the power supply with a voltage no less than 176V, the magnetic force generated by the relay 30' is capable of moving the first switch 31' to connect with the second heating member 22' and the high power water pump 62' within about 20 ms. In this way, the garment steamer 100' is capable of safely operating while generating a constant output without requiring a separate user operation even when the garment steamer 100' is connected to the power supply either 100V or 220V.

The first temperature controller 81' is configured to detect a first temperature of the evaporator assembly 20' and disconnect the evaporator assembly 20' from the power supply when the first temperature exceeds a first preset temperature. The second temperature controller 82' is configured to detect a second temperature of the evaporator assembly 20' and control the low power water pump 60' or the high power water pump 62' to pump the water into the evaporator assembly 20' when the second temperature reaches a second preset temperature.

Figure 15:
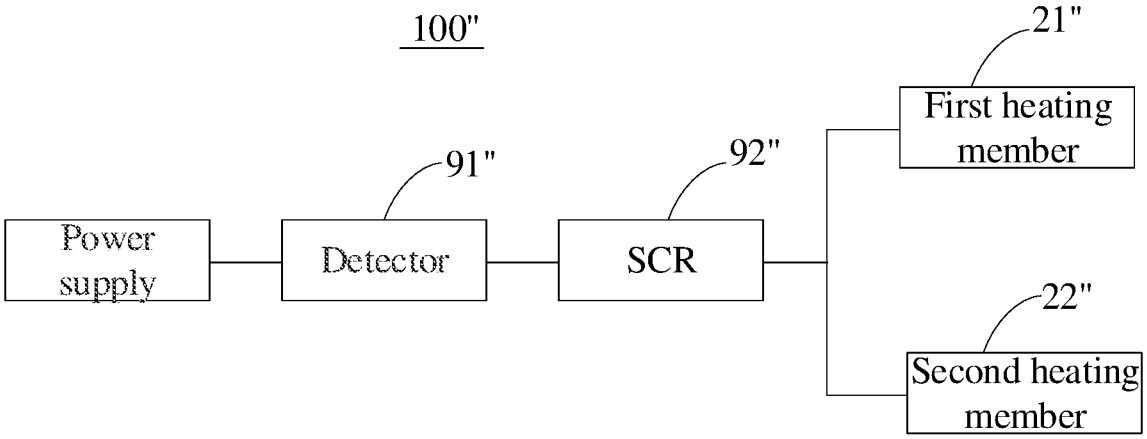
FIG. 15 is a block diagram illustrating a configuration of a garment steamer according to a third embodiment.

Referring to FIG. 15, the present disclosure further provides a garment steamer 100" according to a third embodiment. The garment steamer 100" is similar with the garment steamer 100, the differences between the two at least include: the garment steamer 100" includes a detector 91" and a silicon controlled rectifier (SCR) 92" electrically connected with the detector 91", the detector 91" detects the voltage of the power supply, and the SCR 90" can connect 110V power supply to the first heating member 21" or connects 220V power supply to the second heating member 22" according to a detection result. In this way, the garment steamer 100" is capable of safely operating while generating a constant output without requiring a separate user operation even when the garment steamer 100" is connected to the power supply either 100V or 220V.

Figure 16:
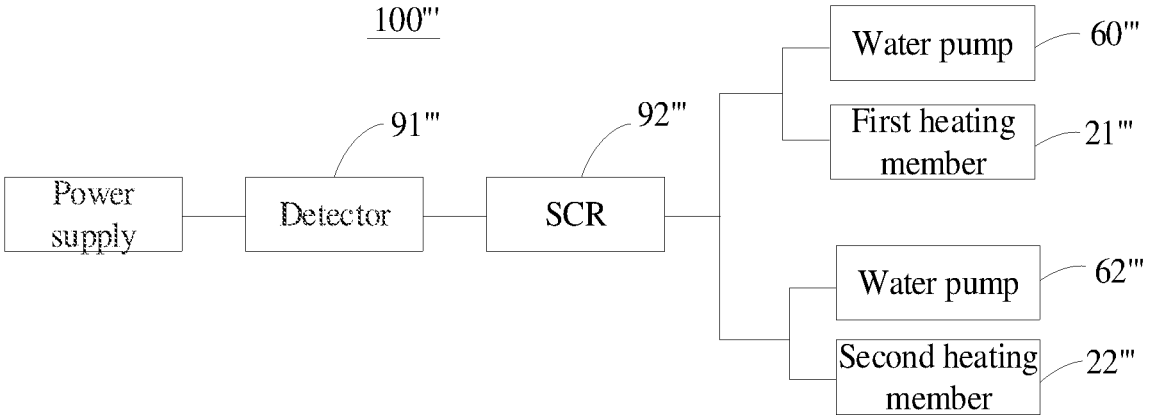
FIG. 16 is a block diagram illustrating a configuration of a garment steamer according to a fourth embodiment.

Referring to FIG. 16, the present disclosure further provides a garment steamer 100''' according to a fourth embodiment. The garment steamer 100''' is similar with the garment steamer 100', the differences between the two at least include: the garment steamer 100''' includes a detector 91''' and a silicon controlled rectifier (SCR) 92''' electrically connected with the detector 91''', the detector 91''' detects the voltage of the power supply, and the SCR 90''' can control 110V power supply to the first heating member 21''' and the low power water pump 60''' or connects 220V power supply to the second heating member 22''' and the high power water pump 62''' according to a detection result. In this way, the garment steamer 100''' is capable of safely operating while generating a constant output without requiring a separate user operation even when the garment steamer 100''' is connected to the power supply either 100V or 220V.

The above description is merely some embodiments. It should be noted that for one with ordinary skills in the art, improvements can be made without departing from the concept of the present disclosure, but these improvements shall fall into the protection scope of the present disclosure.

What is claimed is:

1. A garment steamer, comprising:

a water tank, configured to store water;

an evaporator assembly, communicated with the water tank and configured to generate steam, the evaporator assembly comprises an evaporation chamber, a first heating member, a first receiving member, a second receiving member, and a second heating member, a resistance of the first heating member matches 110V power supply, a resistance of the second heating member matches 220V power supply, wherein the evaporation chamber is communicated with the water tank, the first heating member and the second heating member are cast in the evaporation chamber to heat water in the evaporation chamber;

a switching member, configured to connect 110V power supply to the first heating member or connect 220V power supply to the second heating member automatically;

a first water pump, having a power of about 1-10 w; and a step-down module, electrically connected to the first water pump and a chip, wherein the step-down module is configured to lower an input voltage to an operating voltage suitable for the first water pump and configured to provide a suitable input voltage for the chip;

wherein the evaporator assembly further comprises:

a cover, configured to cover a side of the evaporation chamber, wherein the evaporation chamber, the first receiving member, the second receiving member, and the cover cooperatively define a sub evaporation chamber.

2. The garment steamer according to claim 1, wherein the switching member is a relay, and the relay comprises:

a first switch, normally connected with the first heating member, wherein when the garment steamer is connected with 110V power supply, the first switch remains connecting with the first heating member; and when the garment steamer is connected with 220V power supply, the relay generates a first magnetic force capable of moving the first switch to connect with the second heating member.

3. The garment steamer according to claim 1, wherein the first heating member is separated from the second heating member.

4. The garment steamer according to claim 1, wherein the evaporator assembly further comprises:

another cover, configured to cover another side of the evaporation chamber;

a first receiving member, received in the evaporation chamber and configured to receive the first heating member; and a second receiving member, received in the evaporation chamber and configured to receive the second heating member, wherein the evaporation chamber, the first receiving member, the second receiving member, and the another cover cooperatively define another sub evaporation chamber.

5. The garment steamer according to claim 4, wherein the evaporator assembly further comprises a plurality of first water guiding portions in the another sub evaporation chamber, the first water guiding portions cooperatively form at least one first water flowing channel.

6. The garment steamer according to claim 4, wherein the first another cover comprises:

an inlet portion, communicated with the water tank; and a first through hole, configured to communicate the inlet portion with the another sub evaporation chamber.

7. The garment steamer according to claim 1, wherein the evaporator assembly further comprises a plurality of second water guiding portions in the sub evaporation chamber, the second water guiding portions cooperatively form at least one second water flowing channel.

8. The garment steamer according to claim 1, wherein the first water pump is electronically connected with the chip, the chip controls a water pump speed of the first water pump to adjust a steam output amount of the garment steamer.

9. The garment steamer according to claim 1, further comprising:

a first temperature controller, configured to detect a first temperature of the evaporator assembly and disconnect the evaporator assembly from the power supply when the first temperature exceeds a first preset temperature.

10. The garment steamer according to claim 1, wherein, the first water pump is configured to pump water from the water tank to the evaporator assembly; and the garment steamer further comprises a second temperature controller, configured to detect a second temperature of the evaporator assembly and control the first water pump to pump the water from the water tank into the evaporator assembly when the second temperature reaches a second preset temperature.

11. The garment steamer according to claim 1, wherein the switching member comprises a detector and a silicon controlled rectifier (SCR) electrically connected with the detector, the detector detects an input voltage of the power supply, and the SCR connects 110V power supply to the first heating member or connects 220V power supply to the second heating member according to a detection result of the detector.

12. The garment steamer according to claim 1, further comprising:

a housing and a switch arranged on the housing, wherein the water tank is at least partially received in the housing.

13. The garment steamer according to claim 1, wherein a length of the first heating member is greater than that of the second heating member.

14. The garment steamer according to claim 1, wherein the first heating member or the second heating member is substantially ring shaped, elliptical shaped, square shaped, hexagonal shaped, triangular shaped or irregular shaped.

15. A garment steamer, comprising:

a water tank, configured to store water;

an evaporator assembly, communicated with the water tank and configured to generate steam, wherein the evaporator assembly comprises an evaporation chamber, a first heating member, a first receiving member, a second receiving member, and a second heating member;

a water pump, configured to pump water from the water tank to the evaporator assembly, the water pump has a power of about 1-10 w; and a step-down module, electrically connected to the water pump and a chip, wherein the step-down module is configured to lower an input voltage of 220V power supply to an operating voltage suitable for the first water pump and to provide a suitable input voltage for the chip;

wherein the evaporator assembly further comprises:

a cover, configured to cover a side of the evaporation chamber, wherein the evaporation chamber, the first receiving member, the second receiving member, and the second cover cooperatively define a sub evaporation chamber.

* * * * *